US005142706A

United States Patent [19]

Layhon

[11] Patent Number: 5,142,706

[45] Date of Patent: Sep. 1, 1992

[54] DRESSING GOWN HOOD

[76] Inventor: Vera F. Layhon, Box 135, Pembina, N. Dak. 58271

[21] Appl. No.: 745,196

[22] Filed: Aug. 15, 1991

[51] Int. Cl.[5] ..... A42B 1/00

[52] U.S. Cl. ..... 2/424; 2/202; 2/205; 2/206; 2/410

[58] Field of Search ..... 2/9, 63, 171, 181, 181.4, 2/183, 202, 205, 206, 209.3, 209.5, 209.4, 209.7, 410, 417, 418, 419, 420, 423, 424, DIG. 10

[56] References Cited

U.S. PATENT DOCUMENTS

| | | | |
|---|---|---|---|
| 1,131,350 | 3/1915 | Engelfried | 2/424 |
| 1,510,145 | 9/1924 | Huson | 2/202 |
| 1,800,051 | 4/1931 | Blanco | 2/206 |
| 1,856,879 | 5/1932 | Lufkin | 2/209.5 |
| 2,020,008 | 11/1935 | Yorgensen | 2/206 |
| 3,047,879 | 8/1962 | Spreiregen | 2/181 |
| 3,267,487 | 8/1966 | Johnson | 2/205 |
| 3,562,813 | 2/1971 | Origer | 2/410 |
| 3,951,160 | 4/1976 | Nitu | 2/424 |
| 4,259,748 | 4/1981 | Miller | 2/206 |
| 4,272,853 | 6/1981 | Schuessler | 2/424 |
| 4,324,005 | 4/1982 | Willis | 2/DIG. 10 |
| 4,589,408 | 5/1986 | Singer | 2/205 |
| 5,031,246 | 7/1991 | Kronenberger | 2/418 |

FOREIGN PATENT DOCUMENTS

| | | | |
|---|---|---|---|
| 194657 | 9/1986 | European Pat. Off. | 2/424 |
| 2250513 | 6/1975 | France | 2/410 |
| 2556226 | 6/1985 | France | 2/9 |
| 101104 | 3/1941 | Sweden | 2/424 |
| 861167 | 2/1961 | United Kingdom | 2/424 |
| 974485 | 11/1964 | United Kingdom | 2/424 |

*Primary Examiner*—Werner H. Schroeder
*Assistant Examiner*—Diana L. Biefeld
*Attorney, Agent, or Firm*—Leon Gilden

[57] ABSTRACT

A sanitary dressing gown hood is arranged for securement about a head and shoulder portion of an individual during a dressing gown procedure, wherein a gown is typically directed over an individual's head onto the associated torso portion of the individual, wherein the hood provides a sanitary and static-free barrier during a dressing gown mounting procedure to protect the head portion of the individual from static electricity and contact with the associated dressing gown.

9 Claims, 4 Drawing Sheets

DRESSING GOWN HOOD

BACKGROUND OF THE INVENTION

1. Field of the Invention

The field of invention relates to hood structure, and more particularly pertains to a new and improved dressing gown hood wherein the same is arranged for mounting about the head and shoulders of an individual during a dressing procedure.

2. Description of the Prior Art

Typically in dressing rooms of department stores and the like, gowns are fitted for further examination by a potential customer. During such a procedure, an individual's hairdo is frequently subjected to static electricity to effect disarray of hair and the like discouraging a customer from proper viewing of an associated gown. Further, the dressing gowns and the like are frequently worn by many individuals and the hood provides protection from the individual's mouth and nasal portions from potential viral contamination.

As such, it may be appreciated that there continues to be a need for a new and improved dressing gown hood as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of hood structure now present in the prior art, the present invention provides a dressing gown hood wherein the same is arranged for mounting about the head and shoulder portions of an individual during a dressing gown fitting procedure. As such, the general purpose of the present invention, which will be described subsequently in greater detail, is to provide a new and improved dressing gown hood which has all the advantages of the prior art hood structure and none of the disadvantages.

To attain this, the present invention provides a sanitary dressing gown hood arranged for securement about a head and shoulder portion of an individual during a dressing gown procedure, wherein the gown is typically directed over an individual's head into the associated torso portion of the individual, wherein the hood provides a sanitary and static-free barrier during a dressing gown mounting procedure to protect the head portion of the individual from static electricity and contact with the associated dressing gown.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirt and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dressing gown which has all the advantages of the prior art hood apparatus and none of the disadvantages.

It it another object of the present invention to provide a new and improved dressing gown hood which may be easily and efficiently manufactured and marketed.

It is a further object of the present invention to provide a new and improved dressing gown hood which is of a durable and reliable construction.

An even further object of the present invention is to provide a new and improved dressing gown hood which is susceptible of a low cost of manufacture with regard to both materials and labor, and which accordingly is then susceptible of low prices of sale to the consuming public, thereby making such dressing gown hoods economically available to the buying public.

Still yet another object of the present invention is to provide a new and improved dressing gown hood which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DISCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
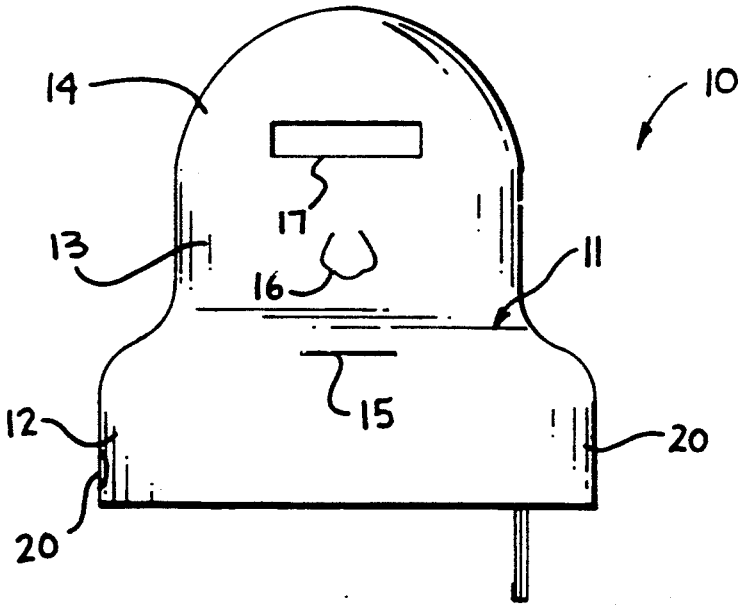
FIG. 1 is an orthographic frontal view, taken in elevation, of the invention.
Figure 2:
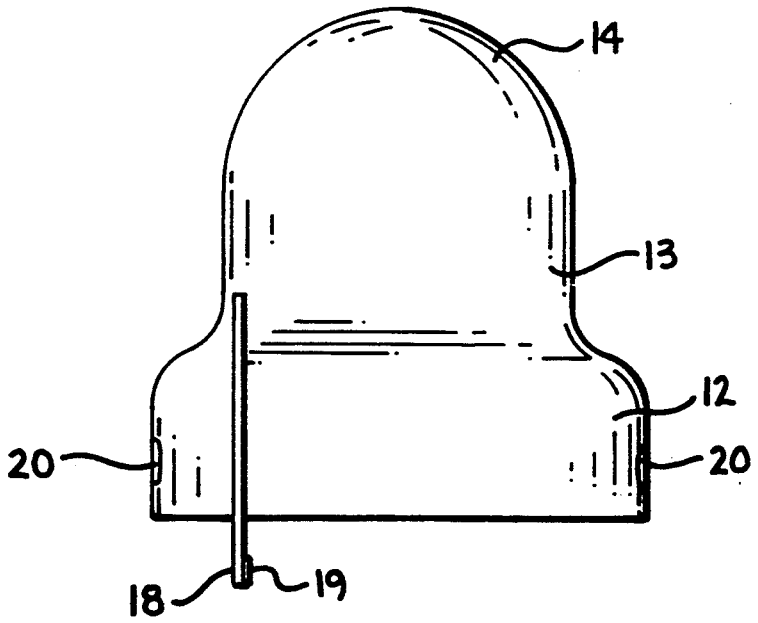
FIG. 2 is an orthographic rear view of the instant invention, taken in elevation.
Figure 3:
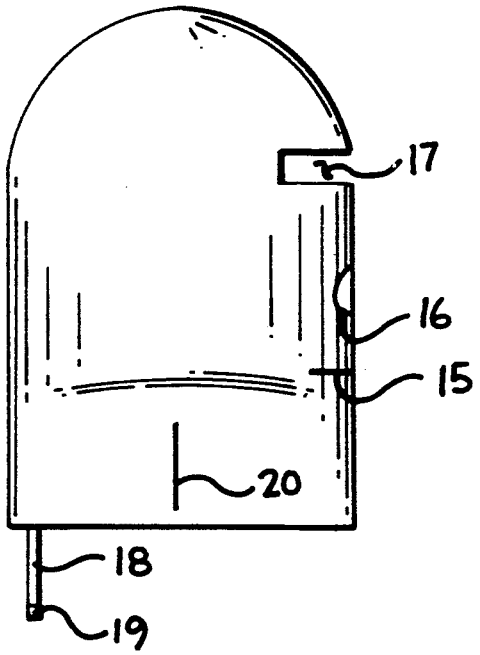
FIG. 3 is an orthographic side view, taken in elevation, of the invention.
Figure 4:
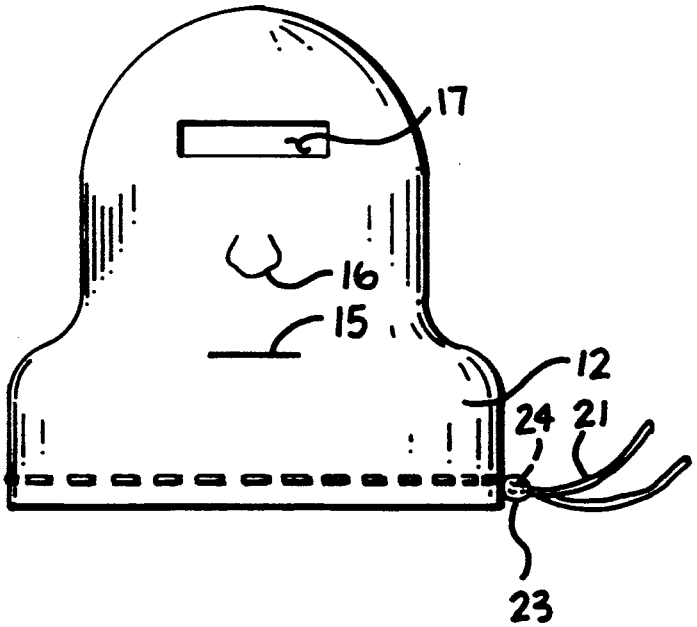
FIG. 4 is and orthographic frontal view of the hood structure utilizing a drawstring.

With reference now to the drawings, and in particular to FIGS. 1 to 9 thereof, a new and improved dressing gown hood embodying the principles and concepts of the present invention and generally designated by the reference numeral 10 will be described.

More specifically, the dressing gown hood 10 of the instant invention essentially comprises a flexible fabric hood 11 defined by a lower oval skirt 12 extending laterally beyond diametrically opposed sides of an upper cylindrical body 13. The upper cylindrical body 13 terminates with a semi-cylindrical crown 14. The lower skirt 12 is arranged to be received upon an individual's shoulder when receiving the upper cylindrical body and the crowns 13 and 14 respectively about the side and upper portion of an individual's head. A first slit 15 is arranged adjacent a first intersection defined between the upper cylindrical body 13 and the skirt 12 for positioning forwardly of an individual's mouth. A second slit 16 of a generally "U" shaped configuration is positioned above and aligned with the first slit 15 medially of the upper cylindrical body 13 for alignment of an individual's nose therewith. A slot 17 is positioned above the second slit 16 at a second intersection between the upper cylindrical body 13 and the crown 14, wherein the slot 17 is aligned with the first and second slits 15 and 16 respectively adjacent the second intersection for positioning forwardly of an individual's eyes. A securement strap 18 mounted to the upper cylindrical body 13 extending downwardly below the skirt 12 includes an adhesive pad 19 mounted at a lower terminal end of the securement strap 18 for securement to an opposed portion of the skirt 12 for enhanced securement of the hood 11 about an individual's head and shoulder portions in a tightening procedure. Third slits 20 are diametrically mounted through the lower skirt 12 orthogonally oriented relative to the first and second slits 15 and 16 providing for expansion of the skirt 12 as required. In lieu of the securement strap 18 and its associated adhesive pad 19, a drawstring 21 is alternatively provided through the lower skirt 12 directed through an annular array of drawstring slots 22 positioned in a parallel relationship relative to a lower terminal edge of the skirt 12. The drawstring 21 is directed through a securement member 23 that includes a bore 24 to frictionally receive the free end portions of the drawstring 21 therethrough, wherein the securement member 23 is positioned exteriorly of the skirt 12, wherein subsequently it may be directed against the skirt 12 when mounted to an individual.

Figure 5:
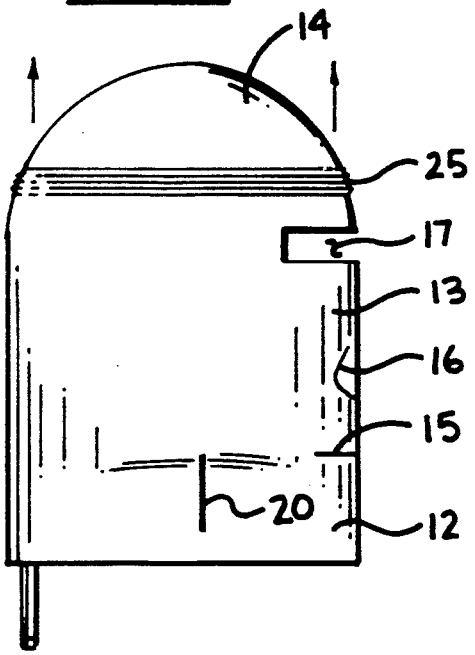
FIG. 5 is the hood structure of the invention utilizing an expandable accordion pleated portion.
Figure 6:
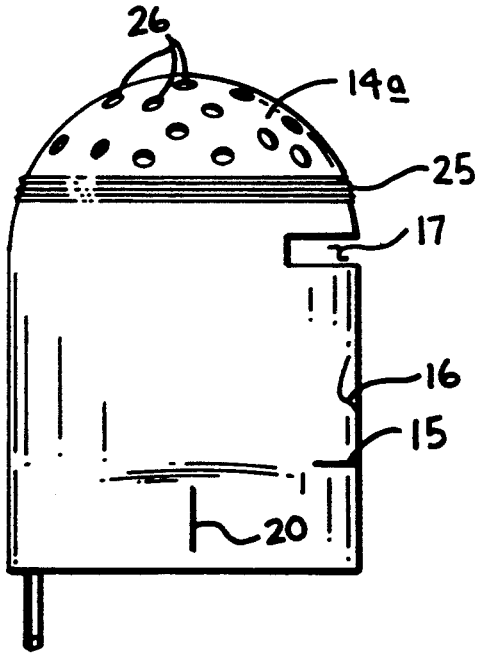
FIG. 6 is the hood structure of the invention further utilizing a vented upper crown portion.

FIG. 5 illustrates the hood 11 further utilizing an accordian pleated portion 25 defined at the second intersection to permit vertical expansion of the crown 14 relative to the upper cylindrical body 13. Further, a modified crown portion 14*a* is contemplated with a matrix of vent openings 26 directed therethrough to permit venting of air within the hood for comfort and ventilation of the hood during use.

Figure 7:
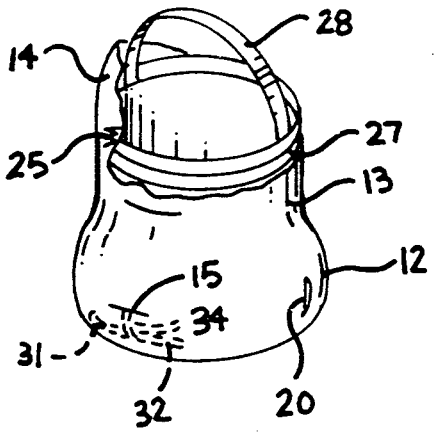
FIG. 7 is an isometric illustration of the hood structure illustrating an internal support band structure.
Figure 8:
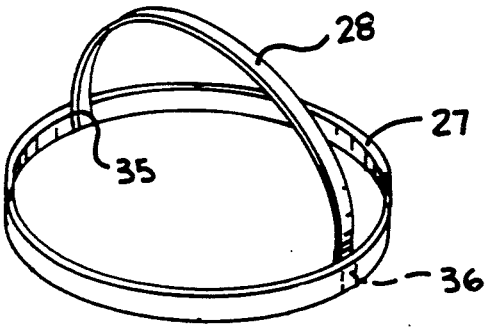
FIG. 8 is an isometric illustration of the support band structure.
Figure 9:
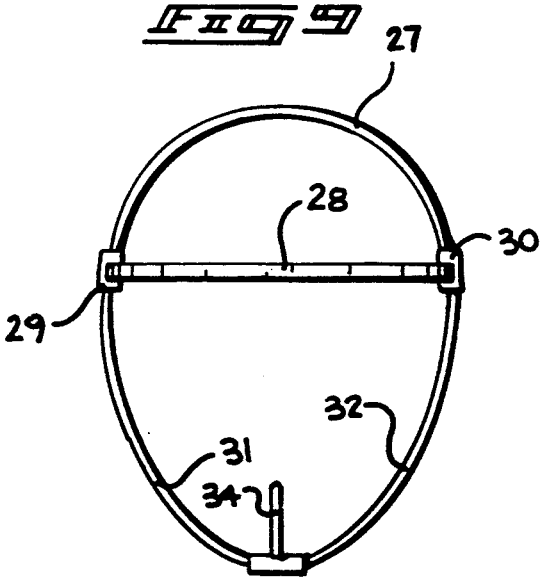
FIG. 9 is an orthographic frontal view, taken in elevation, of the support band structure mounted within the hood of the invention, including an inflation chamber mounted adjacent each intersection of the upper band relative to the lower circumferential band to effect inflation of each pneumatic chamber for mounting of the hood to an individual's head portion.

FIGS. 7 and 8 illustrate the use of a support band structure that includes a flexible circumferential first head band 27 mounted within the upper cylindrical body 13 adjacent to and below the accordian pleated portion 25. The first head band 27 orthogonally mounts a second semi-cylindrical head band 28 directed upwardly and orthogonally intersecting diametrically opposed sides of the first band 27. FIG. 9 illustrates the second head band 28 intersecting the first head band 27 at respective first and second respective head band intersections 35 and 36 to mount a respective first and second pneumatic chamber 29 and 30 to an exterior surface of the first head band adjacent the respective first and second head band intersection. Each of the first and second pneumatic chambers 29 and 30 respectively are simultaneously inflated relative to one another by a respective first and second inflation conduits 31 and 32 that are joined together at an inflation conduit connection 33, wherein the conduit connection 33 includes an inflation tube 34 directed therefrom in alignment with and extending to the first slit 15 for access to an individual's mouth for oral inflation of the first and second chambers 29 and 30 by the inflation tube 34 through the respective first and second inflation conduits 31 and 32 respectively. Upon inflation of the first and second pneumatic chambers 29 and 30, the chambers positioned adjacent ear portions of an individual or approximately thereto effects a pressing of the first band against an individual's head to assist in maintaining the hood in position during a dressing procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, is is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dressing gown hood, comprising, a flexible continuous fabric hood, including a lower oval skirt mounted coaxially to an upper cylindrical body, with the upper cylindrical body including a semi-cylindrical crown mounted to an upper terminal end of the upper cylindrical body, and the lower oval skirt joined continuously to the upper cylindrical body at a first intersection, and the upper cylindrical body joined to the semi-cylindrical crown at a second intersection, and a first slit directed through the hood at the first intersection, and a second slit of a "U" shaped configuration directed through the upper cylindrical body aligned with the first slit, and an eye slot directed adjacent to and below the second intersection aligned with the first slit and the second slit, and securement means mounted to the skirt for securement of the skirt about an individual's shoulder portions.

2. A hood as set forth in claim 1 wherein the skirt includes a plurality of diametrically opposed third slits directed through the skirt, wherein the third slits are rotated ninety degrees relative to the first slit, the second slit, and the slot, wherein the third slits permit expansion of the skirt.

3. A hood as set forth in claim 2 wherein the securement means includes a drawstring directed coextensively through the skirt through an annular array of drawstring slots, the drawstring extending exteriorly of the skirt and received through a securement member, wherein the securement member includes a securement bore means for frictionally engaging the drawstring exteriorly of the skirt for permitting securement of the skirt about the shoulder portions of the individual.

4. A hood as set forth in claim 3 wherein an accordion pleated portion is circumferentially formed at the second intersection to permit expansion of the crown relative to the upper cylindrical body.

5. A hood as set forth in claim 4 wherein the crown includes a matrix of vent openings directed therethrough.

6. A hood as set forth in claim 5 wherein a band means is mounted within the crown for imparting geometric integrity to the crown and the hood in use.

7. A hood as set forth in claim 6 wherein the band means include a first cimcumferential band mounted within the hood below the accordion pleated portion, and the first band includes a second semi-circular band orthogonally intersecting diametrically opposed portions of the first band and extending upwardly of the first band, wherein the second band intersects the first band at respective first and second head band intersections.

8. A hood as set forth in claim 7 wherein the respective first and second head band intersections include respective first and second pneumatic chambers fixedly mounted to the respective first and second head band intersections.

9. A hood as set forth in claim 8 wherein the respective first and second pneumatic chambers include respective first and second inflation conduits in pneumatic communication with the respective first and second pneumatic chambers, and the first and second inflation conduits joined together at a spaced relationship relative to the second band at an inflation conduit connection, and an inflation tube directed into the inflation conduit connection in pneumatic communication with the respective first and second inflation conduits and projecting above the inflation conduits projecting adjacent the first slit to permit oral inflation of the first and second inflation conduits through the inflation tube.

* * * * *